US009539813B2

(12) United States Patent
Iijima et al.

(10) Patent No.: US 9,539,813 B2
(45) Date of Patent: Jan. 10, 2017

(54) LIQUID DISCHARGE HEAD

(71) Applicant: CANON KABUSHIKI KAISHA, Tokyo (JP)

(72) Inventors: Yasushi Iijima, Tokyo (JP); Kenji Yabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/058,573

(22) Filed: Mar. 2, 2016

(65) Prior Publication Data

US 2016/0288502 A1 Oct. 6, 2016

(30) Foreign Application Priority Data

Mar. 30, 2015 (JP) ..... 2015-069105

(51) Int. Cl.
*B41J 2/14* (2006.01)
*B41J 2/16* (2006.01)

(52) U.S. Cl.
CPC ..... *B41J 2/1433* (2013.01); *B41J 2/14088* (2013.01); *B41J 2/162* (2013.01)

(58) Field of Classification Search
CPC ..... B41J 2/14088
See application file for complete search history.

(56) References Cited

U.S. PATENT DOCUMENTS 6,575,560 B2 6/2003 Kaneko et al.
6,676,241 B2 1/2004 Yabe
2005/0200660 A1* 9/2005 Laurer ..... B41J 2/1433 347/58

FOREIGN PATENT DOCUMENTS

JP 2012-051235 A 3/2012

* cited by examiner

*Primary Examiner* — Justin Seo
*Assistant Examiner* — Roger W Pisha, II
(74) *Attorney, Agent, or Firm* — Fitzpatrick, Cella, Harper & Scinto

(57) ABSTRACT

A liquid discharge head including a substrate having a plurality of energy-generating elements which generates energy used to discharge a liquid, and a supply port which is a through-hole for supplying the liquid to the energy-generating elements and which extends along an arrangement direction of the plurality of the energy-generating elements; and a discharge port forming member having a plurality of discharge ports for discharging the liquid and a pair of beam-shaped projections which are parallel to each other, which project toward the substrate, and which are formed along the arrangement direction at positions opposing to the supply port, wherein an interval of the pair of beam-shaped projections is larger than a length of the pair of beam-shaped projections in a direction orthogonal to the arrangement direction of the pair of beam-shaped projections.

9 Claims, 3 Drawing Sheets

LIQUID DISCHARGE HEAD

BACKGROUND OF THE INVENTION

Field of the Invention

The present invention relates to a liquid discharge head which discharges a liquid through discharge ports.

Description of the Related Art

Hitherto, as a liquid discharge head adapted to discharge a liquid, such as an ink, through discharge ports, an ink jet recording head has been known. In such a liquid discharge head, it is known that a discharge port forming member with discharge ports formed therein is generally made of a resin, so that the discharge port forming member gradually swells owing to absorption of a liquid, such as an ink, and a stress occurs in the discharge port forming member due to the swelling. Japanese Patent Application Laid-Open No. 2012-51235 proposes a liquid discharge head provided with beam-shaped projections to thereby enhance the stiffness of a discharge port forming member, thus achieving higher reliability even when a stress is generated. FIG. 3A is an enlarged plan view of a discharge port section of the liquid discharge head, and FIG. 3B is a sectional view taken along line 3B-3B in FIG. 3A.

Referring to FIG. 3A and FIG. 3B, a discharge port forming member 9, which has a plurality of discharge ports 1, is joined to a substrate 11 provided with a plurality of energy-generating elements (heaters) 10. In addition to the plurality of the discharge ports 1, a plurality of bubbling chambers 5 and a plurality of flow paths 6 are formed in the discharge port forming member 9. The substrate 11 has a supply port 2, which is a through-hole for supplying a liquid to the discharge ports 1. The supply port 2 extends in an elongated manner along the arrangement direction of the energy-generating elements 10, i.e. the discharge ports 1. At the positions opposing to the supply port 2 of the discharge port forming member 9, a pair of beam-shaped projections 3 are formed along this direction, a slit 4 being provided between the pair of beam-shaped projections 3. Further, the discharge port forming member 9 has a plurality of reinforcing ribs 7 extending in opposing directions from the pair of beam-shaped projections 3, and a plurality of pillar-shaped projections 8 functioning as filters for removing foreign matters from a liquid supplied to the discharge ports 1.

According to the configuration described above, the beam-shaped projections 3 enhance the stiffness, so that even if a high stress occurs in the beam-shaped projections 3 due to the swelling of the discharge port forming member 9, the stress will be absorbed by the slit 4 and therefore reduced. As a result, a shearing stress acting on that part of the discharge port forming member 9 which is joined to the substrate 11 (especially the pillar-shaped projections 8) can be reduced, thus making it possible to inhibit the pillar-shaped projections 8 from being detached from the substrate 11.

In a liquid discharge head 20 illustrated in FIG. 3A and FIG. 3B, the slit 4 between the pair of beam-shaped projections 3 reduces the stress caused by the swelling of the discharge port forming member 9, so that the detachment of the discharge port forming member 9 can be suppressed. However, if the discharge port forming member 9 is made of, for example, a thermosetting resin, then a new problem arises due to the presence of the slit 4, as described below. FIG. 3C is a sectional view which corresponds to FIG. 3B and which illustrates the discharge port forming member 9 made of a thermosetting resin, which has shrunk after hardening in the liquid discharge head 20 illustrated in FIG. 3A and FIG. 3B. The discharge port forming member 9 hardens in a thermally expanded state in a heat curing process and then shrinks as the temperature thereof decreases. The discharge port forming member 9 also shrinks by the drying during the hardening. The volume shrinkage causes a shrinking force to be generated in the discharge port forming member 9. However, the volume of the beam-shaped projections 3 is large, so that the shrinking force generated is larger accordingly. As a result, the larger shrinking force of the beam-shaped projections 3 causes a high tensile stress to be generated in a part 4*a* corresponding to the slit 4 of the discharge port forming member 9, possibly leading to the occurrence of a crack. If a crack occurs in the part 4*a* corresponding to the slit 4 of the discharge port forming member 9, then a liquid leaks through the crack, resulting in deteriorated reliability.

SUMMARY OF THE INVENTION

To this end, a liquid discharge head in accordance with the present invention includes a substrate having a plurality of energy-generating elements which generates energy used to discharge a liquid and a supply port which is a through-hole for supplying the liquid to the energy-generating elements and which extends along an arrangement direction of the plurality of the energy-generating elements; and a discharge port forming member having a plurality of discharge ports for discharging the liquid and a pair of beam-shaped projections which are parallel to each other, which project toward the substrate, and which are formed along the arrangement direction at positions opposing to the supply port, wherein an interval of the pair of beam-shaped projections is larger than a length of the pair of beam-shaped projections in a direction orthogonal to the arrangement direction of the pair of beam-shaped projections.

In the liquid discharge head, even when a large shrinking force occurs in the pair of beam-shaped projections, the interval (i.e. the width of a slit) is larger than the width of each of the pair of beam-shaped projections, so that a tensile stress acting on a part between the pair of beam-shaped projections can be evenly dispersed over the entire part. In other words, it is possible to suppress the tensile stress intensively acting on the part between the pair of beam-shaped projections, thus suppressing the occurrence of a crack in this part.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1A:
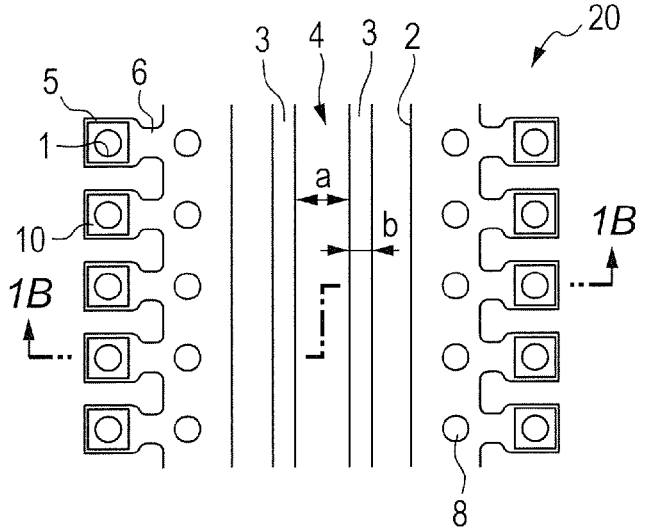
FIGS. 1A, 1B and 1C are enlarged plan views and a sectional view of a liquid discharge head according to a first embodiment.
Figure 1B:
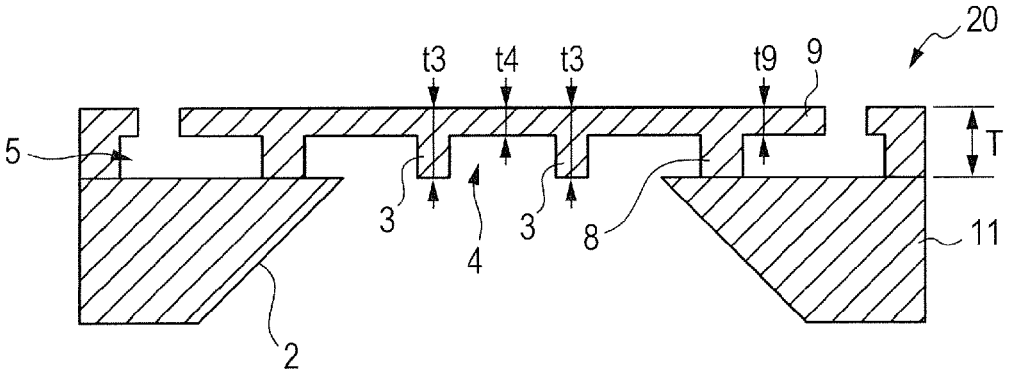

FIG. 1A is an enlarged plan view illustrating the neighborhood of the discharge ports of a liquid discharge head according to a first embodiment of the present invention. FIG. 1B is a sectional view taken along line 1B-1B in FIG. 1A.

A liquid discharge head 20 has a substrate 11 provided with a plurality of energy-generating elements (heaters) 10, which generate energy used for discharging a liquid, and a discharge port forming member 9 joined to a surface of the substrate 11 on which the energy-generating elements 10 are provided. The substrate 11 is made of, for example, silicon, and the discharge port forming member 9 is made of a thermosetting resin, such as an epoxy resin.

Further, the liquid discharge head 20 has a plurality of discharge ports 1 for discharging a liquid, a plurality of bubbling chambers 5 in communication with the discharge ports 1, a plurality of flow paths 6 in communication with the bubbling chambers 5, and a supply port 2 in communication with the plurality of the flow paths 6. The discharge ports 1, the bubbling chambers 5, and the flow paths 6 are formed to correspond to the energy-generating elements 10 of the substrate 11 by a photolithography process. More specifically, the bubbling chambers 5 are formed to embrace the energy-generating elements 10, and the discharge ports 1 are formed at positions opposing to the energy-generating elements 10 in the bubbling chambers 5. The supply port 2 is formed in the substrate 11 such that the supply port 2 passes through the substrate 11 and opens in the surface, to which the discharge port forming member 9 is joined, and extends along the arrangement direction of the energy-generating elements 10, i.e. the discharge ports 1. The energy-generating elements 10 are arranged at a predetermined pitch on both sides of the supply port 2, and the discharge ports 1 are arranged so as to form two arrays thereof accordingly. For example, the pitch and the number of the energy-generating elements 10, i.e. the discharge ports 1, are 600 dpi (1,200 dpi for the case of a zigzag arrangement) and a total of 1,280, respectively. In this case, the length of each of the discharge port lines is approximately 1.07 inches (approximately 2.72 cm).

Further, the liquid discharge head 20 has a plurality of pillar-shaped projections 8 which are formed to project toward the substrate 11 from the discharge port forming member 9 and which are joined to the substrate 11. The pillar-shaped projections 8 are provided between the flow paths 6 and the supply port 2 such that the pillar-shaped projections 8 face the inlets of the flow paths 6 so as to function as filters to remove foreign matters from a liquid supplied to the discharge ports 1. The thickness of the discharge port forming member 9 at the pillar-shaped projections 8 is equal to the thickness T of that part of the discharge port forming member 9 which is joined to the substrate 11 (hereinafter referred to simply as "the thickness of the discharge port forming member") and is, for example, 26 μm.

Further, the liquid discharge head 20 has a pair of beam-shaped projections 3 formed to project toward the substrate 11 from the discharge port forming member 9. The pair of beam-shaped projections 3 are provided at a position opposing to the supply port 2 of the discharge port forming member 9 and placed in parallel to each other along the direction in which the supply port 2 extends, i.e. along the arrangement direction of the plurality of discharge ports 1, a slit 4 being provided between the pair of beam-shaped projections 3. Further, the pair of beam-shaped projections 3 are disposed approximately symmetrically with respect to the centerline of the discharge port forming member 9 along the arrangement direction of the discharge ports 1. The thickness of the discharge port forming member 9 at the beam-shaped projections 3 (hereinafter referred to simply as "the thickness of the beam-shaped projections") t3 is substantially equal to the thickness of the discharge port forming member 9. Therefore, a major part of the beam-shaped projections 3 is not in contact with the substrate 11, but both end parts thereof (not illustrated) in the longer direction are joined to the substrate 11. Thus, the pair of beam-shaped projections 3 function as a reinforcing member for enhancing the stiffness of the discharge port forming member 9 in the arrangement direction of the discharge ports 1. The dimensions of the pair of beam-shaped projections 3 are represented by, for example, a width "a" of the slit 4 being 42 μm, a width "b" of each of the beam-shaped projections 3 being 10 μm, and the thickness of each of the beam-shaped projections 3 being 26 μm, which is equal to the thickness of the discharge port forming member 9 as described above. Further, the thickness of the discharge port forming member 9 at the slit 4 (hereinafter referred to simply as "the slit thickness") t4 is equal to a thickness t9 of the discharge port forming member 9 at the flow paths 6 or the bubbling chambers 5 and is, for example, 10 μm.

Figure 1C:
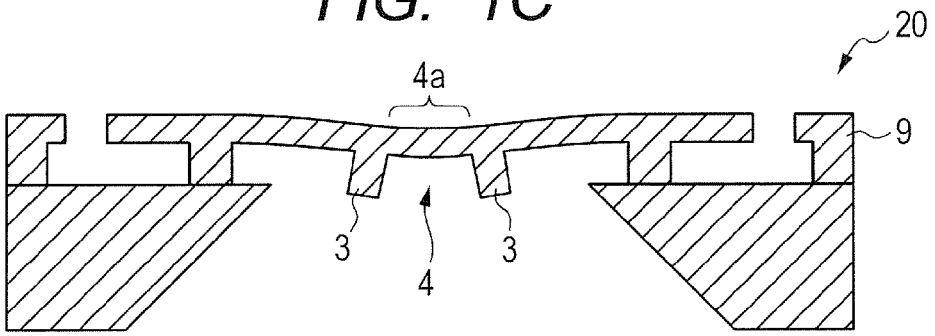

As described above, the liquid discharge head 20 according to the present embodiment is formed such that the interval of the pair of beam-shaped projections 3, i.e. the width "a" of the slit 4, is larger than the width "b" of each of the beam-shaped projections 3 (the length in the direction orthogonal to the direction in which the beam-shaped projections 3 extend). The following will describe the advantage with reference to FIG. 1C. FIG. 1C is a sectional view which illustrates the discharge port forming member 9 made of a thermosetting resin in which the volume shrinkage thereof has occurred after hardening, and which corresponds to FIG. 1B.

The discharge port forming member 9 made of a thermosetting resin hardens in a thermally expanded state in a heat curing process and then thermally shrinks as the temperature thereof decreases. In addition, the volume of the discharge port forming member 9 reduces due to drying at the time of hardening. As the volume of the discharge port forming member 9 reduces, the beam-shaped projections having large volumes significantly shrink, thus generating a tensile force, which acts especially on a part corresponding to the slit 4 of the discharge port forming member 9 (hereinafter referred to simply as "the slit-corresponding part") 4*a*. Hence, the tensile forces caused by the beam-shaped projections 3 act on the slit-corresponding part 4*a* from both sides thereof as a resultant force. According to the present embodiment, however, the wide slit 4 having the width "a" which is greater than the width "b" of each of the beam-shaped projections 3, is capable of suppressing the concentration of the resultant force acting on the slit-corresponding part 4*a*. This means that the stress acting on the slit-corresponding part 4*a* can be evenly dispersed over the entire part, thus making it possible to suppress the occurrence of a crack in the slit-corresponding part 4*a*. Further, the slit-corresponding part 4*a* has the thickness t4, which is sufficiently thinner (e.g. 10 μm) than the thickness t3 of the beam-shaped projection 3, and easily deforms due to the flexibility thereof. Accordingly, the wide slit 4 deforms more than a conventional one and is therefore capable of absorbing more of the tensile force acting on the slit-corresponding part 4*a*. This makes it possible to suppress the damage to the slit-corresponding part 4*a*. The deformation does not cause the discharge ports to affect the liquid discharge performance, so that the occurrence of the foregoing shrinkage does not lead to the occurrence of a liquid discharge failure.

The beam-shaped projections 3 function to suppress the entry of bubbles accumulated in the supply port 2 into the discharge ports 1. As described above, if, for example, the width "b" of each of the beam-shaped projections 3 is 10 μm, then the beam-shaped projections 3 are capable of adequately suppressing the entry of bubbles even if the width "a" of the slit 4 is 42 μm.

Second Embodiment

Figure 2A:
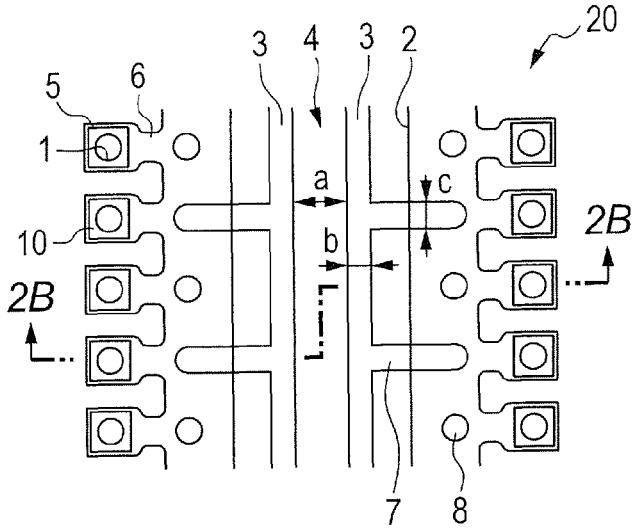
FIGS. 2A, 2B and 2C are enlarged plan views and a sectional view of a liquid discharge head according to a second embodiment.
Figure 2B:
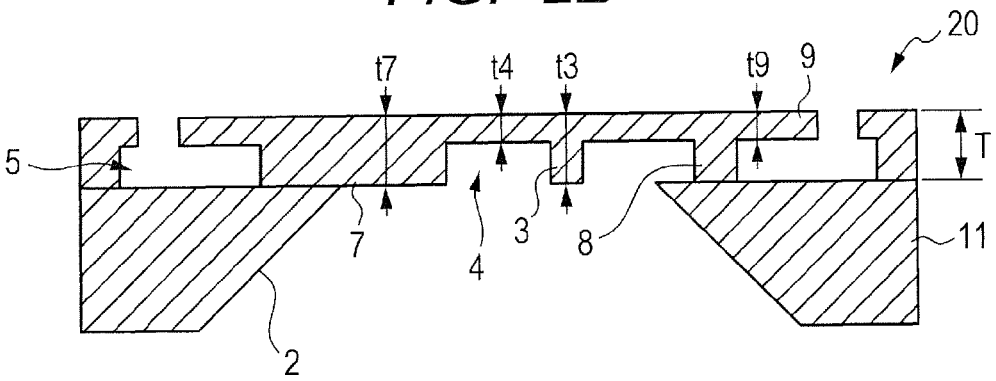
Figure 2C:
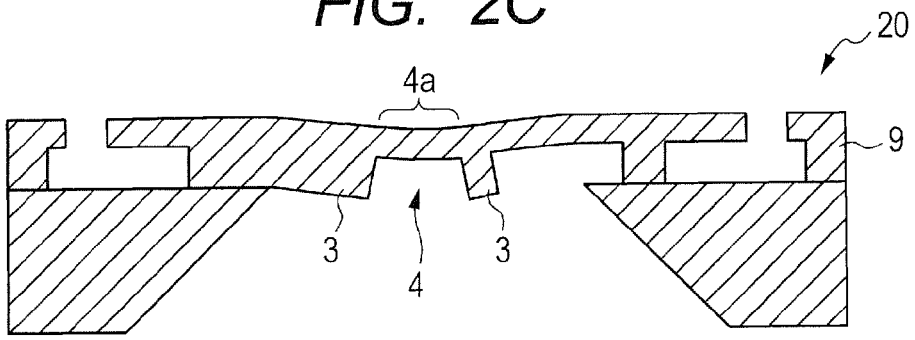
Figure 3A:
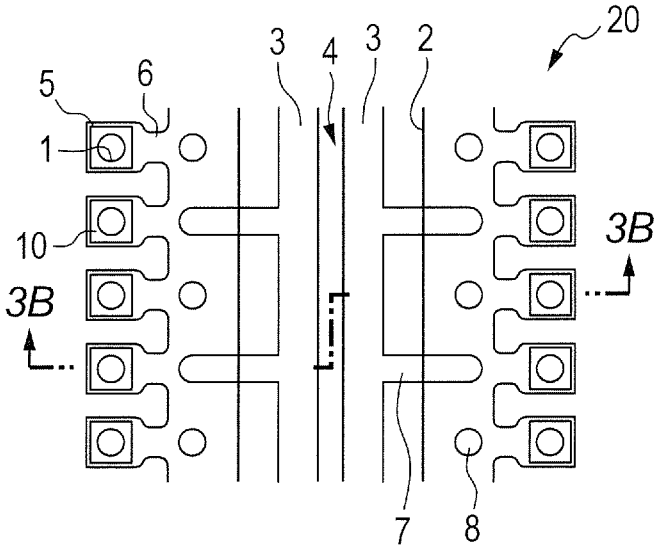
FIGS. 3A, 3B and 3C are enlarged plan views and a sectional view of a conventional liquid discharge head.
Figure 3B:
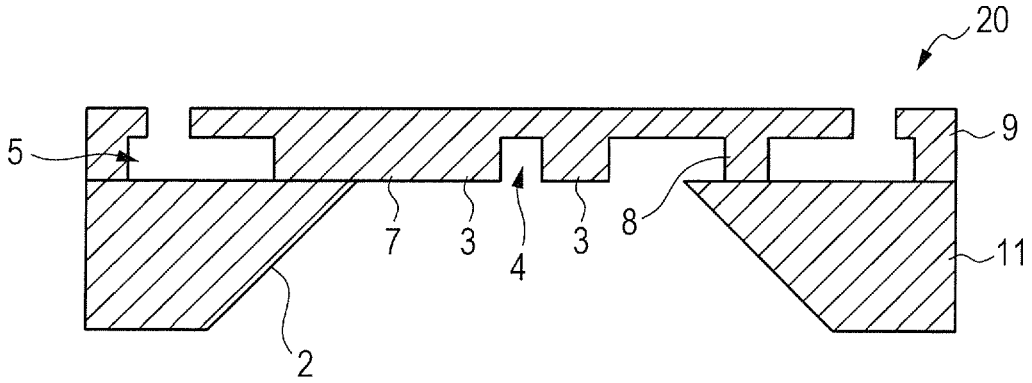
Figure 3C:
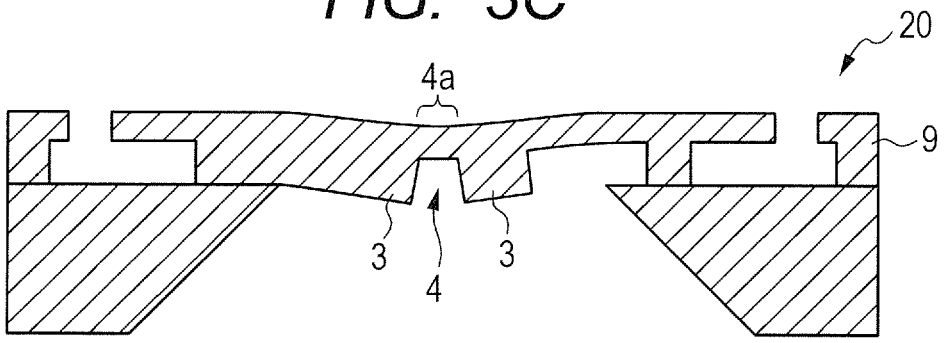

FIG. 2A is an enlarged plan view of the neighborhood of the discharge ports of a liquid discharge head according to a second embodiment of the present invention. FIG. 2B is a sectional view taken along line 2B-2B in FIG. 2A. FIG. 2C is a diagram corresponding to FIG. 1C and illustrates a discharge port forming member in the liquid discharge head according to the present embodiment, in which the volume shrinkage has been caused after hardening.

A liquid discharge head 20 according to the present embodiment has, in place of some pillar-shaped projections 8, a plurality of reinforcing ribs 7, which are formed integrally with beam-shaped projections 3 and which projects from a discharge port forming member 9 toward a substrate 11. The plurality of the reinforcing ribs 7 extend in a direction that intersects with the direction in which the beam-shaped projections 3 extend, i.e. a vertical direction in the present embodiment, and extend in a direction going away from the beam-shaped projections 3. The ends of the reinforcing ribs 7 are joined to the substrate 11. The reinforcing ribs 7 are disposed alternately with the pillar-shaped projections 8 along the direction in which the beam-shaped projections 3 extend, and function as filters for removing foreign matters from a liquid, as with the pillar-shaped projections 8. A width "c" of each of the reinforcing ribs 7 is equal to the diameter of each of the pillar-shaped projections 8. A thickness t7 of the discharge port forming member 9 at the reinforcing ribs 7 is equal to a thickness T of the discharge port forming member 9 and is, for example, 26 μm.

According to the present embodiment, the reinforcing ribs 7 make it possible to increase the area where the discharge port forming member 9 and the substrate are joined and also to enhance the close adhesion between the discharge port forming member 9 and the substrate 11. Further, the stiffness of the discharge port forming member 9 in the direction in which the reinforcing ribs 7 extend can be also enhanced. Thus, even if the discharge port forming member 9 made of a resin absorbs a liquid and swells to cause a shearing stress in the discharge port forming member 9 (especially the pillar-shaped projections 8), the detachment of the discharge port forming member 9 from the substrate 11 can be suppressed. Further, the stress attributable to the swelling of the discharge port forming member 9 can obviously be absorbed also by a slit 4.

On the other hand, since the reinforcing ribs 7 are formed integrally with the beam-shaped projections 3, the influence of the stress caused by the discharge port forming member 9 is greater than that in the first embodiment, and the tensile force acting on the slit-corresponding part 4*a* is larger than that in the first embodiment accordingly. Therefore, the plurality of the reinforcing ribs 7 are preferably formed such that the width "c" of each of the reinforcing ribs 7 is larger than a width "b" of each of the beam-shaped projections 3 in order to suppress the transmission of the shrinking force generated in the reinforcing ribs 7 to the slit-corresponding part 4*a*. Hence, even if a shrinking force is generated in the reinforcing ribs 7, the beam-shaped projections 3 are deformed so as to make it possible to reduce the shrinking force and therefore to minimize the tensile force acting on the slit-corresponding part 4*a*. As a result, damage to the discharge port forming member 9 can be obviated. Thus, according to the present embodiment, the stress caused by the shrinkage of the discharge port forming member and the influence of the stress caused by the swelling can be effectively suppressed.

The foregoing embodiments have described the liquid discharge heads, which have the discharge port forming members 9 made of a thermosetting resin; however, the present invention is not limited thereto. The present invention can be applied to other cases insofar as the discharge port forming member is formed of a resin or the like and deforms when the discharge port forming member is heated or absorbs a liquid. For example, the present invention is ideally applied to a case where a thermosetting adhesive agent is used to join a discharge port forming member and a substrate, or a case where a discharge port forming member is heated by, for example, driving energy-generating elements when a liquid discharge head is used.

Further, in the foregoing embodiments, the description has been given of the case where the pair of beam-shaped projections 3 extend in parallel to each other; however, the present invention is not limited thereto. The present invention applies insofar as a pair of beam-shaped projections extend side by side. In the case where the interval of the beam-shaped projections or the width of the beam-shaped projections varies from one part to another, the present invention applies insofar as the dimension of a part having a largest interval of the beam-shaped projections is larger than the dimension of a part having a smallest width of the beam-shaped projection. Further, the beam-shaped projections may intermittently extend rather than continuously extend.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-069105, filed Mar. 30, 2015, which is hereby incorporated by reference herein in its entirety.

What is claimed is:

1. A liquid discharge head comprising:

a substrate having a plurality of energy-generating elements which generates energy used to discharge a liquid, and a supply port which is a through-hole for supplying the liquid to the energy-generating elements and which extends along an arrangement direction of the plurality of the energy-generating elements; and a discharge port forming member having a plurality of discharge ports for discharging the liquid and a pair of beam-shaped projections which are parallel to each other, which project toward the substrate, and which are formed along the arrangement direction at positions opposing to the supply port, wherein an interval of the pair of beam-shaped projections is larger than a length of the pair of beam-shaped projections in a direction orthogonal to the arrangement direction of the pair of beam-shaped projections.

2. The liquid discharge head according to claim 1, wherein the discharge port forming member has a plurality of reinforcing ribs which are formed integrally with the pair of beam-shaped projections and which project from the discharge port forming member toward the substrate and extend in a direction going away from the pair of beam-shaped projections, end portions of the plurality of reinforcing ribs are joined to the substrate, and a length of the plurality of reinforcing ribs in a direction orthogonal to the direction going away from the pair of beam-shaped projections is larger than a length of the plurality of reinforcing ribs in a direction orthogonal to the arrangement direction of the pair of beam-shaped projections.

3. The liquid discharge head according to claim 2, wherein the discharge port forming member has a plurality of pillar-shaped projections that project from the discharge port forming member toward the substrate and are joined to the substrate, and wherein the plurality of reinforcing ribs are arranged alternately with the plurality of the pillar-shaped projections along the arrangement direction.

4. The liquid discharge head according to claim 1, wherein both ends of the pair of beam-shaped projections in a longer direction thereof are joined to the substrate.

5. The liquid discharge head according to claim 1, wherein the pair of beam-shaped projections are disposed symmetrically with respect to a centerline of the discharge port forming member along the arrangement direction.

6. The liquid discharge head according to claim 1, wherein the discharge port forming member is made of a thermosetting resin.

7. The liquid discharge head according to claim 1, wherein the pair of beam-shaped projections are linearly arranged in parallel along an arrangement direction of the plurality of discharge ports.

8. The liquid discharge head according to claim 1, wherein an area that is on a surface where the plurality of discharge ports are provided and that corresponds to positions where the pair of beam-shaped projections are provided projects toward the supply port.

9. The liquid discharge head according to claim 2, wherein the direction in which the pair of beam-shaped projections extend and the direction in which the plurality of reinforcing ribs extend from the pair of beam-shaped projections are orthogonal to each other.

* * * * *